US010103469B1

(12) United States Patent
Humphrey et al.

(10) Patent No.: US 10,103,469 B1
(45) Date of Patent: Oct. 16, 2018

(54) RECEPTACLE TERMINAL WITH STABLE CONTACT GEOMETRY

(71) Applicant: TE CONNECTIVITY CORPORATION, Berwyn, PA (US)

(72) Inventors: David Tracy Humphrey, Red Lion, PA (US); Raymond L. Landon, III, Elizabethtown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/479,589

(22) Filed: Apr. 5, 2017

(51) Int. Cl.
*H01R 11/22* (2006.01)
*H01R 13/115* (2006.01)
*H01R 4/18* (2006.01)

(52) U.S. Cl.
CPC ..... *H01R 13/115* (2013.01); *H01R 4/185* (2013.01)

(58) Field of Classification Search
CPC ... H01R 13/111; H01R 13/187; H01R 13/115; H01R 13/113
USPC ..... 439/842, 845, 849–852
See application file for complete search history.

(56) References Cited

U.S. PATENT DOCUMENTS 2,768,361 A * 10/1956 Aquillon ..... H01R 13/432 439/732
2,774,951 A * 12/1956 Hammell ..... H01R 11/22 439/849
2,787,774 A * 4/1957 Martines ..... H01R 13/115 439/849
2,888,662 A * 5/1959 Hammell ..... H01R 13/115 439/850
2,921,287 A * 1/1960 Anderson ..... H01R 13/115 439/849
3,086,193 A * 4/1963 Berg ..... H01R 11/22 439/849
3,152,856 A * 10/1964 Batcheller ..... H01R 13/115 439/849
3,204,214 A 8/1965 Eisert
3,228,207 A * 1/1966 Hartmann, Jr. ..... H01R 13/115 439/849
3,320,574 A 5/1967 Tuchel
3,546,663 A 12/1970 Holmberg
3,550,069 A * 12/1970 Teagno ..... H01R 13/115 439/849

(Continued)

FOREIGN PATENT DOCUMENTS

DE 7807279 U1 8/1978
EP 0602681 A2 6/1994

OTHER PUBLICATIONS

U.S. Appl. No. 15/479,644, filed Apr. 5, 2017.

*Primary Examiner* — Thanh Tam Le

(57) ABSTRACT

A receptacle terminal for receipt of a mating terminal therein. The receptacle terminal includes a contact portion having a bottom wall and resilient arms which extend from either side of the bottom wall. The bottom wall has a raised portion with a first embossment position proximate a lead-in surface at a mating end of the contact portion. The bottom wall has a second embossment spaced from the first embossment, the first and second embossments providing additional strength and stability to the contact portion to prevent unwanted bending of the terminal. This provides a stable electrical connection while allowing for a lower insertion force of the mating terminal into the socket terminal.

15 Claims, 4 Drawing Sheets

(56) References Cited

U.S. PATENT DOCUMENTS

| | | | | | |
|---|---|---|---|---|---|
| 3,729,701 | A * | 4/1973 | Smith | H01R 13/115 | 439/850 |
| 4,174,878 | A | 11/1979 | Debaigt | | |
| 4,220,388 | A * | 9/1980 | Dechelette | H01R 13/115 | 439/268 |
| 4,415,221 | A | 11/1983 | Inoue et al. | | |
| 4,445,745 | A | 5/1984 | Cartesse | | |
| 4,448,468 | A * | 5/1984 | Coldren | H01R 13/20 | 439/266 |
| 4,534,613 | A * | 8/1985 | Esser | H01R 13/115 | 439/834 |
| 5,295,874 | A * | 3/1994 | Yoneda | H01R 13/115 | 439/850 |
| 5,395,270 | A * | 3/1995 | Jinno | H01R 13/115 | 439/850 |
| 5,733,154 | A * | 3/1998 | Libregts | H01R 4/182 | 439/850 |
| 6,039,615 | A | 3/2000 | Suzuki | | |
| 6,068,526 | A * | 5/2000 | Nottrott | H01R 13/11 | 439/845 |
| 6,293,831 | B1 * | 9/2001 | Yamatani | H01R 13/113 | 439/849 |
| 6,997,746 | B2 | 2/2006 | Taylor | | |
| 7,166,002 | B2 | 1/2007 | Fukuda et al. | | |
| 7,255,614 | B1 * | 8/2007 | Irish | H01R 13/113 | 439/849 |
| 7,845,993 | B2 * | 12/2010 | Falchetti | H01R 13/113 | 439/843 |

* cited by examiner

RECEPTACLE TERMINAL WITH STABLE CONTACT GEOMETRY

FIELD OF THE INVENTION

The present invention is directed to a terminal with a stable contact geometry. In particular, the invention is directed to a socket type terminal in which the contact points are controlled to provide a stable electrical connection while allowing for a lower insertion force of the mating terminal.

BACKGROUND OF THE INVENTION

Socket terminals which are adapted for quick make and break connections with a mating terminal are known. Terminals of this kind are often made from thin sheet metal and are used to make an electrical connection to a male or space terminal which is inserted and frictionally held in the socket terminal. A socket terminal of this type is shown in U.S. Pat. No. 3,086,193.

It is often necessary to disconnect and reconnect such terminals a number of times for testing purposes prior to final inspection and shipment of the product on which such terminals are used. It is also required that the connection made with such terminals be maintained under conditions of vibration and possible strain in subsequent service.

It would, therefore, be beneficial to provide a socket type terminal which maintains a stable geometry, thereby allowing the contact points to be controlled even in environments in which the terminal is subject to vibration and the like. It would also be beneficial to provide a stable electrical connection while allowing for a lower insertion force of the mating terminal into the socket terminal.

SUMMARY OF THE INVENTION

An object is to provide a socket type terminal which maintains a stable geometry, thereby allowing the contact points to be controlled even in environments in which the terminal is subject to vibration and the like.

An object is to provide a socket type terminal which provides a stable electrical connection while allowing for a lower insertion force of the mating terminal into the socket terminal.

An embodiment is directed to a receptacle terminal for receipt of a mating terminal therein. The receptacle terminal includes a contact portion having a bottom wall and resilient arms which extend from either side of the bottom wall. The bottom wall has a raised portion with a first embossment position proximate a lead-in surface at a mating end of the contact portion. The bottom wall has a second embossment spaced from the first embossment, the first and second embossments providing additional strength and stability to the contact portion to prevent unwanted bending of the terminal.

An embodiment is directed to a receptacle terminal for receipt of a mating terminal therein. The receptacle terminal has a contact portion including a bottom wall and resilient arms which extend from either side of the bottom wall. The bottom wall has a raised portion with a first embossment position proximate a lead-in surface at a mating end of the contact portion. The bottom wall has a second embossment spaced from the first embossment, the first and second embossments providing additional strength and stability to the contact portion to prevent unwanted bending of the terminal. A spring arm extends from the bottom wall, the spring arm has a third embossment which extends from the spring arm to create a raised area on the inner surface of the spring arm.

An embodiment is directed to a receptacle terminal for receipt of a mating terminal therein. The receptacle terminal has a contact portion including a bottom wall and resilient arms which extend from either side of the bottom wall. The bottom wall has a raised portion with a first rib position proximate a lead-in surface at a mating end of the contact portion. The bottom wall has a second rib spaced from the first embossment, the first and second ribs providing additional strength and stability to the contact portion to prevent unwanted bending of the terminal. The resilient arms have arcuate portions which extend from the bottom wall to mating terminal engaging members. The mating terminal engaging members extend from the arcuate portions toward the bottom wall in a direction which is essentially perpendicular to the plane of the bottom wall. The mating terminal engagement surfaces are positioned at a top of a mating slot. The arcuate portions provide the resiliency to allow the mating terminal engaging member to move relative to the bottom wall as the mating terminal is inserted into the mating slot.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
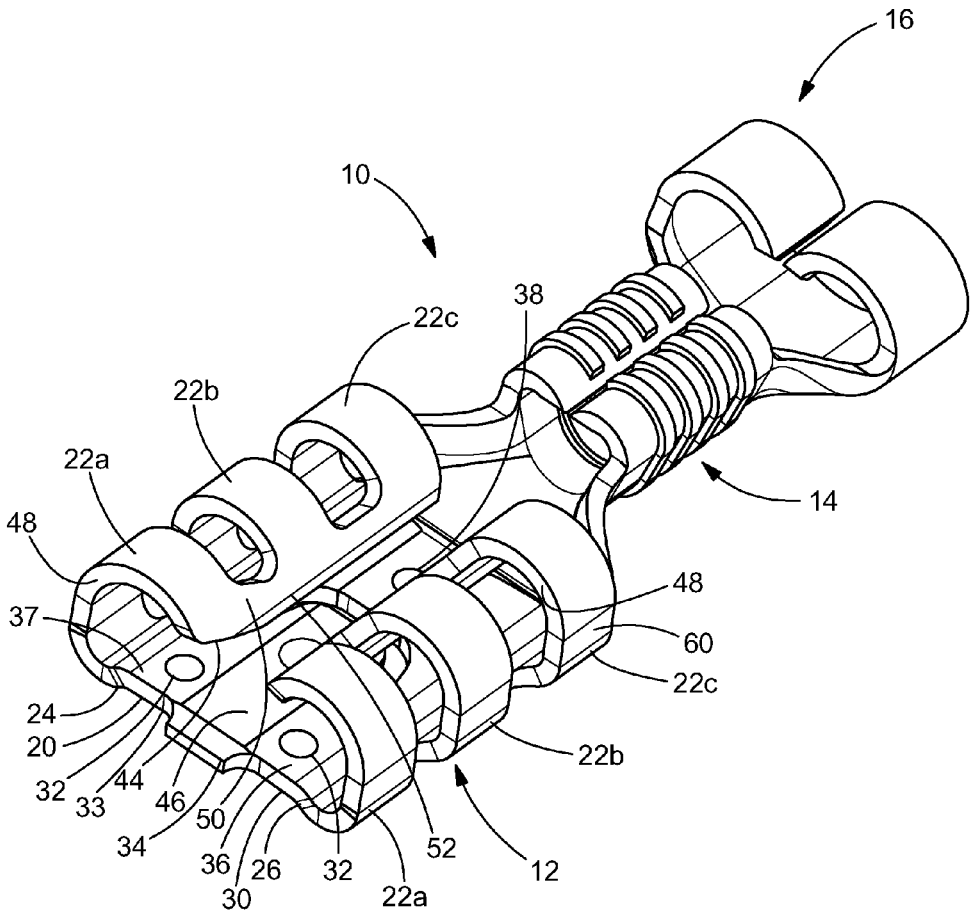
FIG. 1 is perspective view of an illustrative embodiment of the terminal according to the present invention.
Figure 2:
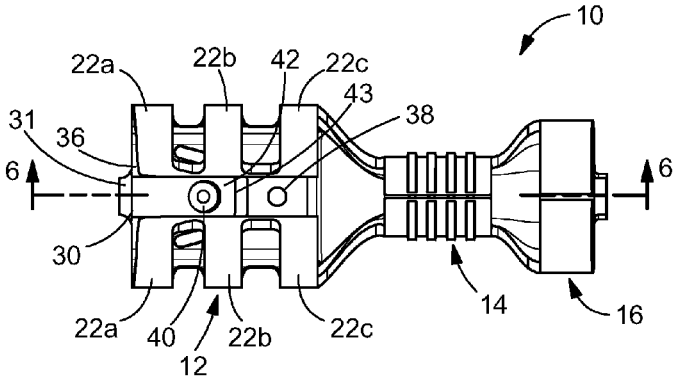
FIG. 2 is a top view of the terminal of FIG. 1.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

As best shown in FIGS. 1-4, a receptacle, socket or female terminal 10 includes a contact portion 12, a wire barrel 14 behind the contact portion 12 and an insulation barrel 16 behind the wire barrel 14. The wire barrel 14 is configured for crimped connection with an end of a conductive core of an insulated wire. The insulation barrel 16 is configured for crimped connection with an end of the insulation coating or jacket of the wire. Although a wire barrel 14 and an insulation barrel 16 are shown, the contact portion 12 can be used with other types of termination members without departing from the scope of the invention. In the illustrative embodiment shown, the terminal 10 is stamped and formed from a metal plate having a good electrical conductivity.

Figure 5:
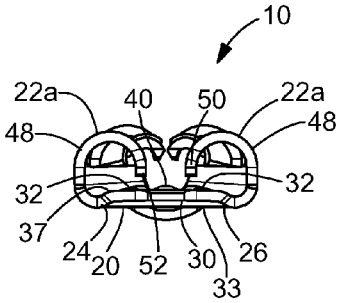
FIG. 5 is a front view of the terminal of FIG. 1.
Figure 3:
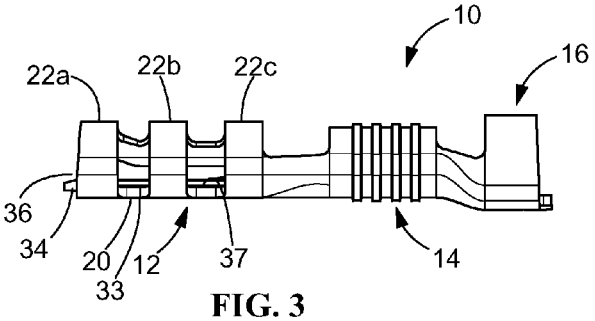
FIG. 3 is a side view of the terminal of FIG. 1.
Figure 6:
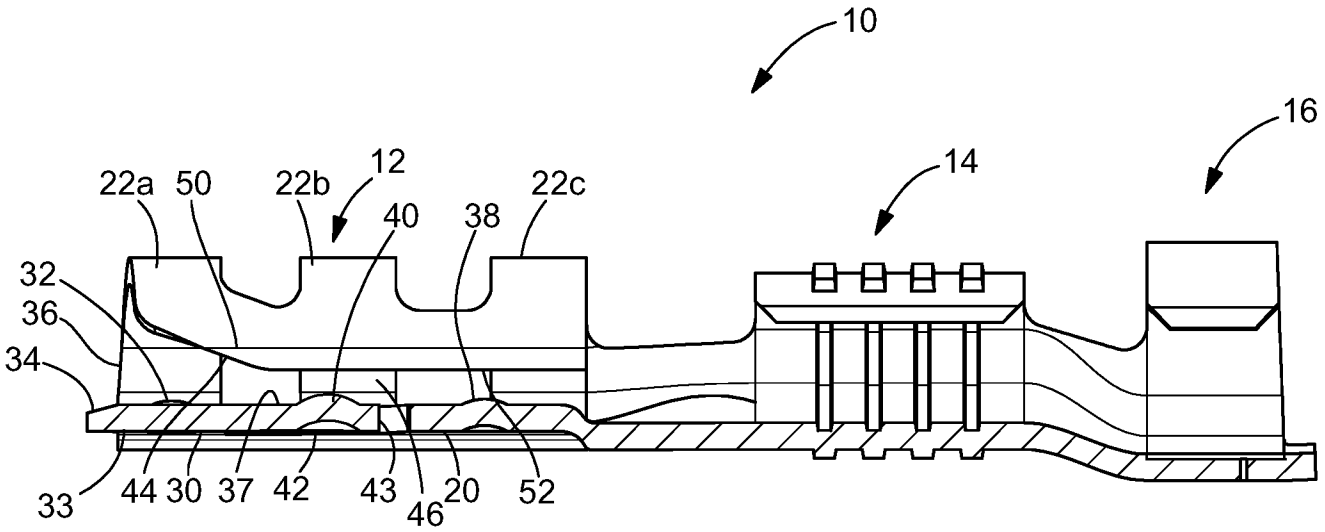
FIG. 6 is a cross-sectional view of the terminal of FIG. 2, taken along line 6-6.

Referring to FIGS. 1, 5 and 6, the contact portion 12 includes a bottom wall 20 and resilient arms 22 which extend from either side 24, 26 of the bottom wall 20. As best shown in FIG. 6, the bottom wall 20 has a raised portion 30 with a lead-in surface 34 at the mating end 36 of the contact portion 12. The raised portion 30 provides additional strength and stability to the contact portion 12. The raised portion 30 reinforces the bottom wall 20 to prevent unwanted bending of the terminal, as will be better explained below.

The raised portion 30 provide increased stiffness to the bottom surface 20 and the contact portion 12 to achieve the desired normal force for the insertion of a mating contact (not shown). The raised portion 30 provides a distribution of mechanical stresses, thereby reducing or eliminating the need for an assist spring to help create the required normal force for mating. In the illustrative embodiment shown, the raised portion 30 is a rectangular platform which provides sufficient stiffness to the terminal 10 to properly control the geometry of the terminal 10 as the mating terminal is inserted therein.

Embossments, such as, but not limited to detents, dimples or lance-through raised shapes 32 are positioned on the raised portion 30 proximate the mating end 36. The embossments 32 are stamped or coined from the raised portion 30 of the bottom wall 20. The embossments 32 extend from the bottom wall 20 to create raised bumps on the inner surface 37 of the bottom wall 20. The embossments 32 are spaced apart and engage the mating terminal as the mating terminal is inserted into the terminal 10, as will be more fully described. While two embossments 32 are shown, other numbers and configurations of the embossments 32 can be used. In the embodiment shown, the embossments 32 have an oval configuration, although other configurations may be used. For example, the embossments 32 may also be in the form of elongated dimples or ribs.

Figure 7:
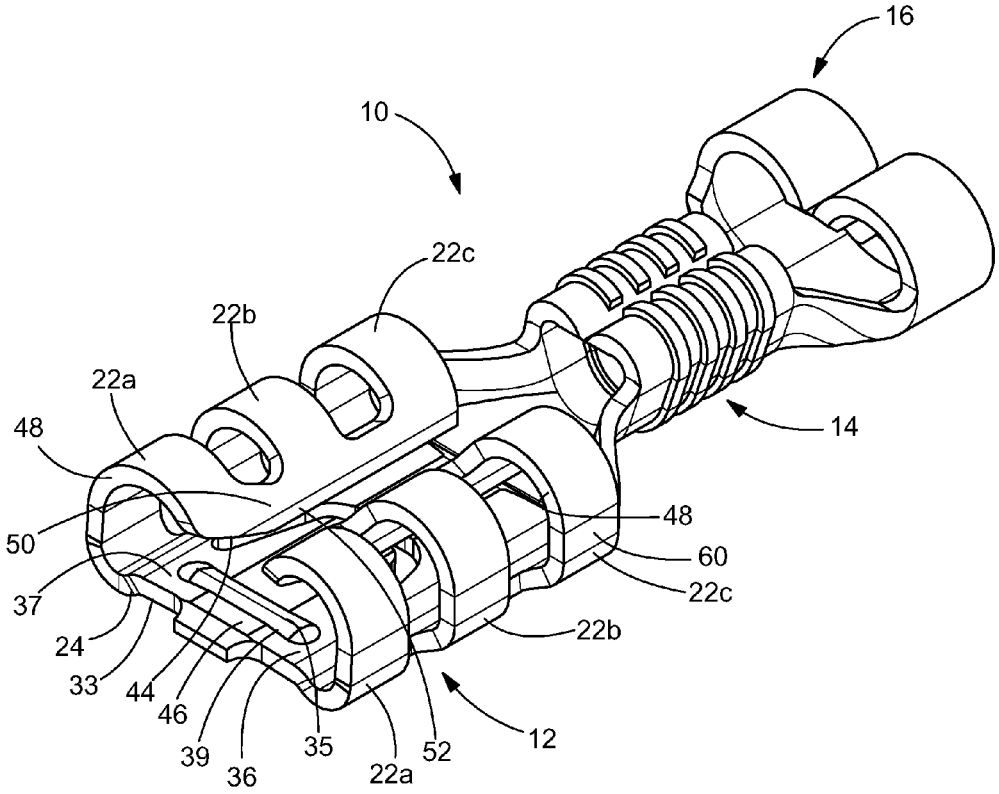
FIG. 7 is perspective view of an alternate illustrative embodiment of the terminal according to the present invention.

For example, FIG. 7 illustrates and alternative embodiment in which the embossment is a rib 39. The rib 39 provides additional strength and stability to the contact portion 12. The rib 39 reinforces the bottom wall 20 to prevent unwanted bending of the terminal. In the exemplary embodiment shown, the rib 39 is a thin, generally rectangular member which extends transversely to the longitudinal axis of the contact portion 12, creating an indent on the outer surface 33 of the bottom wall 20 and a raised bump 35 on the inner surface 37 of the bottom wall 20. However, other configurations of the rib 39 may be used to provide the required strengthening properties. The rib may be provided proximate the mating end and/or spaced from the mating end.

An embossment, such as, but not limited to detent, dimple or lance-through raised shape 38 is positioned on the raised portion 30 proximate the wire barrel 14. The embossment 38 is stamped or coined from the raised portion 30 of the bottom wall 20. The embossment 38 extends from the bottom wall 20 to create raised bumps on the inner surface 37 of the bottom wall 20. The embossment 38 is spaced apart from the embossments 32 and engages the mating terminal as the mating terminal is inserted into the terminal 10, as will be more fully described. While one embossment 38 is shown, other numbers and configurations of the embossment 30 can be used. In the embodiment shown, the embossments 38 have an oval configuration, although other configurations may be used. For example, the embossment 38 may also be in the form of elongated dimples or ribs.

The raised portion 30 also includes an embossment, such as, but not limited to a detent, dimple or lance-through raised shape 40 provided thereon. The embossment 40 extends from the bottom wall 20 to create a raised portion or arm extending from the inner surface 37 of the bottom wall 20 toward the resilient arms 22. The embossment 40 engages the mating terminal as the mating terminal is inserted into the terminal 10, as will be more fully described below.

Figure 4:
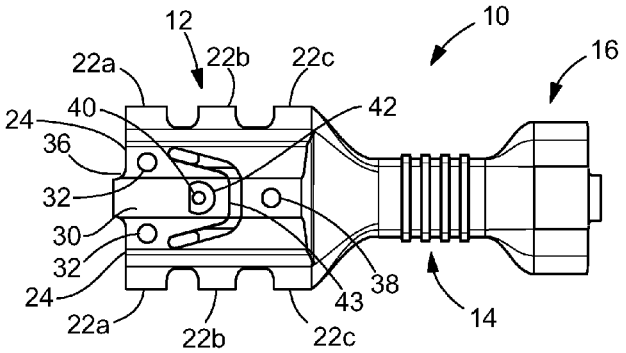
FIG. 4 is a bottom view of the terminal of FIG. 1.

The embossment 40 may be stamped, coined or formed from the bottom wall 20 or a spring arm 42. In various embodiments, a spring arm 42 may also be provided on the bottom wall 20. The spring arm 42 is stamped and formed from the raised portion 30. Spring arm 42 may have a U-shaped configuration, as shown in FIG. 4, or may have numerous other configurations, such as, but not limited, to rectangular or round. The spring arm 42 is formed to allow a free end 43 thereof to move or be resiliently deformed relative to the bottom wall 20, allowing the spring arm 42 to move toward and away from the resilient arms 22.

In the illustrative embodiment shown, the spring arm 42 has the embossment 40 provided thereon. The embossment 40 extends from the spring arm 42 to create a raised portion which extends from the inner surface of the spring arm 42 toward the mating terminal engaging member 50. The embossment 40 is provided proximate to, but spaced from, the free end 43 of the spring arm 42.

In the illustrative embodiment shown, three resilient arms 22 extend from either side 24, 26 of the bottom wall 20. The first resilient arm **22*a* is positioned proximate the mating end 36 of the contact portion 12. The resilient arms 22*a*, 22*b*, 22*c* have arcuate or curled portions 48 which extend from the bottom wall 20 to a mating terminal engaging member 50, as best shown in FIGS. 1 and 6. The mating terminal engagement members 50 are asymmetrical in the illustrative embodiment shown, having lead-in surfaces 44 positioned proximate the mating end 36. The lead-in surfaces 44 are provided to help guide the mating terminal into the mating slot 46 of the contact portion 12 and to reduce the insertion force required to insert the mating terminal into the slot 46. A mating terminal engagement surface 52 is provided on each mating terminal engaging member 50. In the embodiment shown, the mating terminal engaging member 50 extends from the arcuate portions 48 toward the bottom wall in a direction which is essentially perpendicular to the plane of the bottom wall 20, positioning the mating terminal engagement surface 52 at the top of the mating slot 46. The configuration of the arcuate portions 48** provide the resiliency needed to allow the mating terminal engaging member 50 to move relative to the bottom wall 20 as the mating terminal is inserted into the slot 46. This allows for the contact portion 12 to compensate for any slight misalignment of the mating terminal or any slight warpage or imperfections associated with the mating terminal.

In a fully inserted position, the embossment 40, the embossments 32, 38 and the mating terminal engagement surfaces 52 are all provided in electrical and mechanical contact with the mating terminal. The multiple areas of contact allow the receptacle contact 10 to be used in applications in which higher current levels, such as, but not limited to, 15 to 20 or more amps. The configuration of the embossment, 40, embossments 32, 38 and mating terminal engagement surfaces 52 provide for higher hertzian stresses, thereby eliminating or minimizing the fretting corrosion between the mating terminal 10, thereby providing a stable and reliable electrical connection between the mating terminal and the terminal 10.

As best shown in FIG. 6, the embossments 40, the embossments 32, 38 and the mating terminal engagement surfaces 52 are spaced laterally relative to each other, allowing the connection between the mating terminal and the receptacle terminal 10 to be stable in all environments, thereby insuring that the mating terminal will remain properly positioned in the receptacle terminal 10 as vibration occurs.

In addition, as the embossments 40, the embossments 32, 38 and the mating terminal engagement surfaces 52 are laterally offset from each other, the receptacle terminal 10 provides multiple contact areas even if the mating terminal is bent, causing the mating terminal to not engage a particular area. In addition, the multiple contact areas resist twisting or misalignment of the mating terminal.

In one embodiment, the resilient arms 22 are configured such that the contact areas of the mating terminal engagement surfaces 52 generate an equal and opposite force to resist the force generated by the free end 43 of the spring arm 42 and the embossment 40 and the embossments 32, 38. In addition, the resilient arms 22 are configured such that contact areas of the free end 43 of the spring arm 42 and the embossment 40 and the contact areas of the embossments 32, 38 generate an equal and opposite force to resist the force generated by the mating terminal engagement surfaces 52. However, the configuration of the resilient arms 22 may be varied to allow the contact areas to have varied forces associated therewith. In particular, the positioning of the embossment 40 and the embossments 32, 38 can alter the force applied by each contact area.

As the embossment 40 and the embossments 32, 38 are transversely offset relative to the path of insertion of the mating terminal, the plating wear on the mating terminal at any particular area is minimized, as the wear is distributed over different areas.

The configuration of the bottom wall 20 and the resilient arms 22 and the use of multiple contact areas allows for a lower normal force during mating and unmating of the mating terminal from the receptacle contact 10. This allows the mating terminal and receptacle contact 10 to be more durable over numerous cycles, as there is less plating wear due to the lower mating or normal forces. The number of contact areas also allows the receptacle contact 10 to be used at higher current levels, as the number of contact areas allows the extreme heat associated with the high current levels to be dispersed, thereby preventing welding of the contact asperities.

A socket type terminal which maintains a stable geometry is provided, thereby allowing the contact points to be controlled even in environments in which the terminal is subject to vibration and the like. The stable electrical connection is provided while allowing for a lower insertion force of the mating terminal into the socket terminal.

While the invention has been described with reference to a preferred embodiment, it will be understood by those skilled in the art that various changes may be made and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A receptacle terminal for receipt of a mating terminal therein, the receptacle terminal having a contact portion comprising:

a bottom wall and resilient arms which extend from either side of the bottom wall, the bottom wall having a raised portion with a first embossment positioned proximate a lead-in surface at a mating end of the contact portion, the bottom wall having a second embossment spaced from the first embossment, the first embossment being a thin generally rectangular rib member which extends transversely to the longitudinal axis of the contact portion, creating an indent on an outer surface of the bottom wall and a raised bump on an inner surface of the bottom wall, the first and second embossments providing additional strength and stability to the contact portion to prevent unwanted bending of the terminal and to achieve the desired normal force for the insertion of a mating terminal;

wherein a spring arm extends from the bottom wall; and wherein a third embossment is stamped, coined or formed from the spring arm of the bottom wall, the third embossment extends from the spring arm to create a raised area on the inner surface of the spring arm.

2. The receptacle terminal as recited in claim 1, wherein the first embossment is stamped or coined from of the raised portion of the bottom wall.

3. The receptacle terminal as recited in claim 2, wherein the second embossment is stamped or coined from the raised portion of the bottom wall, the second embossment extends from the bottom wall to create raised bump on the inner surface of the bottom wall which engages a mating terminal as the mating terminal is inserted into the receptacle terminal.

4. The receptacle terminal as recited in claim 3, wherein the first embossment and the second embossment are transversely offset relative to the path of insertion of the mating terminal, wherein plating wear on the mating terminal at any particular area is minimized.

5. The receptacle terminal as recited in claim 1, wherein three resilient arms extend from either side of the bottom wall, first resilient arms are positioned proximate the mating end of the contact portion, the first resilient arms have lead-in surfaces provided to help guide the mating terminal into a mating slot of the contact portion.

6. The receptacle terminal as recited in claim 5, wherein the resilient arms have arcuate portions which extend from the bottom wall to mating terminal engaging members.

7. The receptacle terminal as recited in claim 6, wherein the mating terminal engaging members extend from the arcuate portions toward the bottom wall in a direction which is essentially perpendicular to the plane of the bottom wall, mating terminal engagement surfaces are positioned at a top of a mating slot, the arcuate portions provide the resiliency to allow the mating terminal engaging member to move relative to the bottom wall as the mating terminal is inserted into the mating slot.

8. The receptacle terminal as recited in claim 7, wherein the first embossment, the second embossment and the mating terminal engagement surfaces are all provided in electrical and mechanical contact with the mating terminal, allowing the receptacle contact to be used in applications in which higher current levels of 15 to 20 or more amps.

9. A receptacle terminal for receipt of a mating terminal therein, the receptacle terminal having a contact portion comprising:

a bottom wall and resilient arms which extend from either side of the bottom wall, the bottom wall having a raised portion with a first embossment positioned proximate a lead-in surface at a mating end of the contact portion, the bottom wall having a second embossment spaced from the first embossment, the first embossment being a thin generally rectangular rib member which extends transversely to the longitudinal axis of the contact portion, creating an indent on an outer surface of the bottom wall and a raised bump on an inner surface of the bottom wall, the first and second embossments providing additional strength and stability to the contact portion to prevent unwanted bending of the terminal:

a spring arm extends from the bottom wall, the spring arm has a third embossment which extends from the spring arm to create a raised area on the inner surface of the spring arm.

10. The receptacle terminal as recited in claim 9, wherein the second embossment is a thin generally rectangular member which extends transversely to the longitudinal axis of the contact portion, creating an indent on an outer surface of the bottom wall and a raised bump on an inner surface of the bottom wall.

11. The receptacle terminal as recited in claim 9, wherein resilient arms extend from either side of the bottom wall, first resilient arms are positioned proximate the mating end of the contact portion, the first resilient arm has a lead-in surface provided to help guide the mating terminal into a mating slot of the contact portion.

12. The receptacle terminal as recited in claim 11, wherein the resilient arms have arcuate portions which extend from the bottom wall to mating terminal engaging members.

13. The receptacle terminal as recited in claim 12, wherein the mating terminal engaging members extend from the arcuate portions toward the bottom wall in a direction which is essentially perpendicular to the plane of the bottom wall, the mating terminal engagement surfaces are positioned at a top of a mating slot, the arcuate portions provide the resiliency to allow the mating terminal engaging member to move relative to the bottom wall as the mating terminal is inserted into the mating slot.

14. The receptacle terminal as recited in claim 13, wherein the first embossment, the second embossment, the third embossment and the mating terminal engagement surfaces are all provided in electrical and mechanical contact with the mating terminal, allowing the receptacle contact to be used in applications in which higher current levels of 15 to 20 or more amps.

15. The receptacle terminal as recited in claim 14, wherein the first embossment, the second embossment and the third embossment are transversely offset relative to the path of insertion of the mating terminal, wherein plating wear on the mating terminal at any particular area is minimized.

* * * * *